United States Patent [19]

Niina

[11] Patent Number: 4,644,891

[45] Date of Patent: Feb. 24, 1987

[54] UNIT FOR MOUNTING HOOD OF WATERCRAFT

[75] Inventor: Jiro Niina, Kobe, Japan

[73] Assignee: Kawasaki Jukogyo Kabushiki Kaisha, Kobe, Japan

[21] Appl. No.: 847,250

[22] Filed: Apr. 2, 1986

[30] Foreign Application Priority Data

Apr. 3, 1985 [JP] Japan ..... 60-70517

[51] Int. Cl.[4] ..... B63B 19/14

[52] U.S. Cl. ..... 114/201 R; 440/38; 16/266; 16/374

[58] Field of Search ..... 114/201 R, 203, 270, 114/357, 361; 180/182; 440/77, 38, 89, 270; 296/191, 192, 193, 194, 196; 16/266, 374

[56] References Cited

U.S. PATENT DOCUMENTS

| | | | |
|---|---|---|---|
| 2,785,921 | 3/1957 | Barenyi | 296/196 |
| 2,963,734 | 12/1960 | Huget | 16/266 |
| 3,389,854 | 6/1968 | Coopersmith | 16/374 |
| 3,438,073 | 4/1969 | Brown | 9/1 |
| 3,572,813 | 3/1971 | Takada | 180/182 |
| 3,688,856 | 9/1972 | Boehm et al. | 180/182 |
| 3,834,340 | 9/1974 | Thorpe | 114/201 R |
| 4,362,118 | 12/1982 | Koch et al. | 114/201 R |
| 4,515,424 | 5/1985 | Sakurai | 16/266 |
| 4,584,739 | 4/1986 | Könen | 16/266 |

FOREIGN PATENT DOCUMENTS

| | | |
|---|---|---|
| 49-58595 | 6/1974 | Japan . |
| 1291904 | 10/1972 | United Kingdom . |

*Primary Examiner*—Galen Barefoot
*Assistant Examiner*—Stephen P. Avila
*Attorney, Agent, or Firm*—Leydig, Voit & Mayer

[57] ABSTRACT

The present invention provides a hood mounting unit for a watercraft including a hull and a hood, the unit including at least one hinge having first and second hinge elements, the first hinge element being received in a groove formed in the second hinge element and having a pin capable of being received in a through-bore formed in the second hinge element, whereby the hood can easily and simply be mounted on or removed from the hull.

5 Claims, 9 Drawing Figures

UNIT FOR MOUNTING HOOD OF WATERCRAFT

BACKGROUND OF THE INVENTION

The present invention relates to a small-sized watercraft including an openable and removable hood hinged to both the hull and hood sides and more particularly to a unit for mounting the hood on the hull of the watercraft.

Japanese Laid-Open Patent Application No. 58596/1974 discloses a small-sized watercraft comprising a step located on the rearward portion of the hull and on which an operator stands, and a vertically rotatable handle pole on the forward portion of the hull, the rearward end of the handle pole supporting a bar-like steering handle.

Such a type of watercraft also comprises an openable hood provided on a deck defining the upper portion of the hull to cover an engine mounted within the hull. The openable hood may also be removable from the hull to provide an easier access for engine maintenance.

To this end, the prior art watercraft further comprises a band of rubber one end of which is hooked on a part of the deck forwardly of the hood. The band extends over the hood in contact with the top face thereof with the other end of the band being detachably attached to the other part of the deck rearwardly of the hood. Thus, the hood can resiliently be held on the hull of the watercraft by means of the rubber band. However, a larger force is required to mount the hood on the hull or to remove it from the hull. Furthermore, the hood may be accidentally disengaged from the hull when the watercraft is subjected to a side wave.

Another attempt has been made in which a hood is openable and removably mounted on the hull in such a manner that a pin on one of two hinge elements respectively provided on the deck and hood is received in an opening in the other hinge element. In such an arrangement, however, it is cumbersome to re-mount the hood on the hull since the pin must be received in the opening while holding the hood in the operator's arms.

SUMMARY OF THE INVENTION

It is therefore an object of the present invention to provide a hood mounting unit which can easily and simply re-mount a hood on the hull of a watercraft without holding the hood in an operator's arms.

To accomplish the above object, the present invention provides a hood mounting unit suitable for use in a small-sized watercraft comprising a hull and a hood, said unit comprising at least one hinge means disposed between the hull and the hood and including first and second hinge elements, said first hinge element having a first engaging portion provided on the distal end of said first hinge element having a constant width in one direction at one side, said second hinge element having a hood-rotation guide groove having the same width as that of the distal end of said first hinge element and two opposite upright walls located on the opposite sides of said hood-rotation guide groove, one of said upright walls being formed with a second engaging portion engageable with said first engaging portion when said first engaging portion is moved in said one direction, the other of said upright walls being formed with a hood-removal guide groove engaged by the distal end of said first hinge element when said first hinge element is moved vertically relative to said hood-removal guide groove, said hood-removal guide groove having a guide face for guiding said first hinge element such that the first hinge element can be moved relative to said second hinge element in said one direction to engage said first hinge element with said second engaging portion.

DESCRIPTION OF THE PREFERRED EMBODIMENTS

Figure 1:
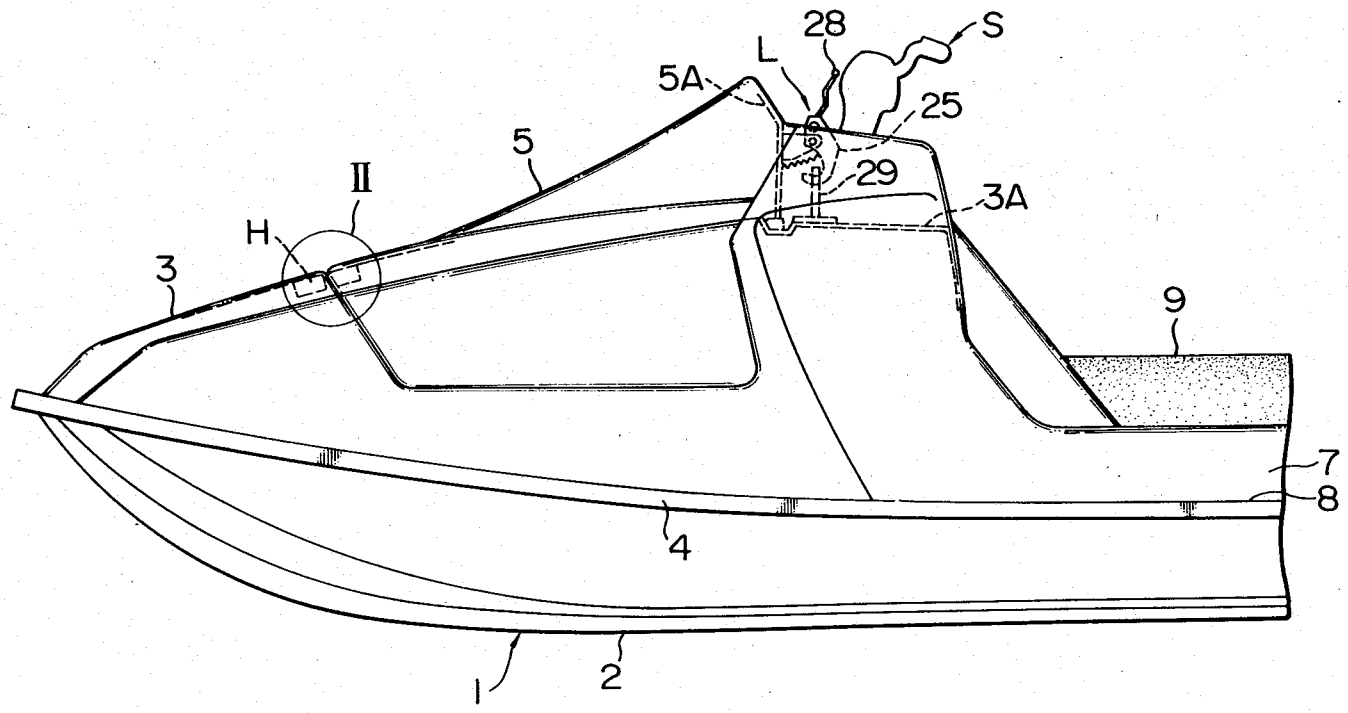
FIG. 1 is a left-hand side elevational view of a small-sized watercraft incorporating a hood mounting unit which is one embodiment of the present invention.

Referring now to FIG. 1, there is shown a small-sized watercraft having a hull 1 which comprises a lower hull portion 2 and an upper deck portion 3. The lower and upper portions 2 and 3 are made of fiber reinforced plastic (FRP) and sealingly joined with each other at their peripheral flanges 4.

The deck portion 3 extends from the bow to the stern of the hull and includes a forward portion on which a hood 5 for covering an engine (not shown) mounted within the hull is openably mounted. The hull 1 includes an upright wall located behind the hood 5, as shown by broken line 5A in FIG. 1. The lower end of the upright wall 5A is sealingly mounted, through a sealing element of rubber, on a mounting wall 3A which is formed integrally in the top wall of the hull rearwardly of the hood 5. A steering unit S is mounted on the hull 1 through the mounting wall 3A at a central position in the width direction of the hull 1.

The portion of the deck portion 3 rearwardly of the steering unit S comprises a seat mount 7 raised at the central position in the width direction of the hull 1, foot rests 8 outwardly extending from the opposite sides of the seat mount 7 and located below the seat mount 7, all of which parts are formed integrally on the deck portion 3. The top face of the seat mount 7 rigidly supports a seat 9 which an operator takes.

The hood 5 has a substantially inverse C-shaped cross-section and is openably and removably mounted on the deck portion 3 through forward hinge means H and rearward latch means L.

Figure 2:
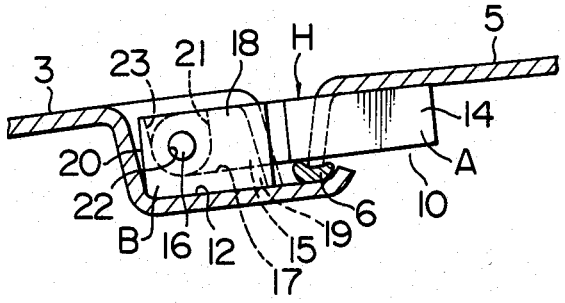
FIG. 2 is an enlarged cross-sectional view of parts encircled by a circle designated II in FIG. 1.

As best seen from FIG. 2, the forward hinge means H includes two pairs of first and second hinge elements A and B transversely arranged relative to the hood 5. The first hinge elements A are rigidly mounted on the forward edge of the hood 5 at its bottom face while the second hinge elements B are fixedly mounted on the rearward edge of a deck opening over which the hood 5 is to be mounted.

The rearward edge of the deck opening is formed with a recess 1 for receiving a packing. The recess 1 includes a pair of transversely spaced hinge fixing grooves 12 formed therein at the forward edge thereof and each of which is in the form of a notch formed in part of the hull 1. Each of the hinge fixing grooves 12 fixedly receives the corresponding one of the second hinge elements B with a space 13 remaining between the second hinge element B and one of the sides of the groove 12.

On the other hand, as shown in FIG. 2, each of the first hinge elements A has its proximal end rigidly connected with the bottom face of the hood 5 with its distal end extending forwardly.

Figure 4:
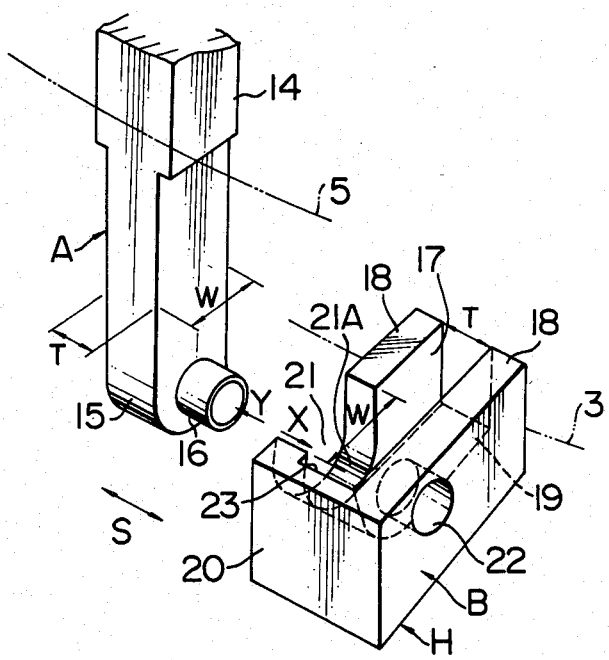
FIGS. 4 through 7 are perspective views illustrating a hood mounting unit at various operative positions.

Each pair of first and second hinge elements A and B are assembled with each other as shown in FIG. 4.

The first hinge element A is in the form of a square column which has two opposite side faces extending parallel to each other in a direction S as viewed in FIG. 4 and each having a width T and two opposite side faces extending parallel to each other and perpendicular to said side faces and each having a width W. The distal end (lower end in FIG. 4) of the first hinge element A is a semi-circular end having a diameter W.

One of the side faces of the first hinge element A rigidly supports a first engaging portion 16 of a cylindrical column configuration which is located coaxially with said semi-circular end and extends outwardly therefrom.

On the other hand, the second hinge element B includes a pair of first and second transversely opposed upright walls 18 and a hood-rotation guide groove 17 disposed between the first and second upright walls 18. The first and second upright walls 18 are connected integrally with each other through a bottom wall 19 and a front wall 20.

The guide groove 17 has a width T equal to the width T of the first hinge element A and are opened upwardly and rearwardly.

The first upright wall 18 is formed with an L-shaped hood-removal guide groove 21 communicating with the hood-rotation guide groove 17. The second upright wall 18 is formed with a second engaging portion 22 which is in the form of a through-bore formed in the second upright wall 18.

The first engaging portion 16 on the first hinge element A can be received in the guide groove 21 in a direction denoted by an arrow X or in the downward direction only when the distal end 15 of the first hinge element A is in its upstanding position as shown in FIG. 4. To this end, the guide groove 21 has a width W and a semi-circular bottom end 21A having a diameter W. The bottom end 21*a* of the guide groove 21 is flush with the bottom face of the guide groove 17.

The second engaging portion 22 has a diameter equal to that of the first engaging portion 16 and located coaxially with the semi-circle of the guide groove 21.

In such an arrangement, as shown in FIG. 4, the first hinge element A is moved in the arrow direction X while holding it in its vertically upstanding position until the distal end 15 thereof rides on the hood-removal guide groove 21, as shown in FIG. 4.

When the distal end 15 of the first hinge element A is received in the guide groove 21, the hood 5 (FIG. 1) is supported in both the force-and-aft and vertical directions and held in its upstanding position. At the same time, the first and second engaging portions 16 and 22 are aligned with each other in the common center axis.

Figure 5:
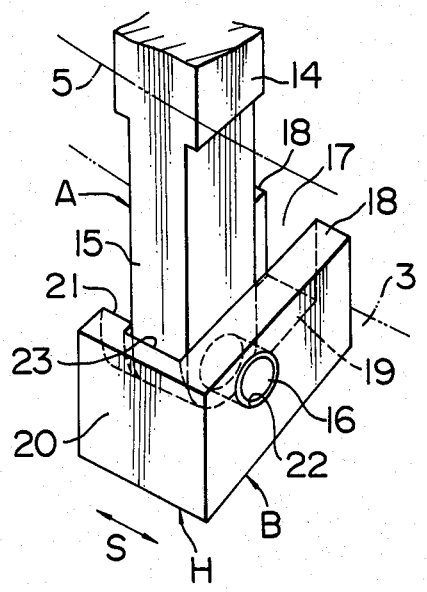

As the first hinge element A is slidably moved in the arrow direction X under the above alignment state, the first engaging portion or pin 16 can be inserted into the second engaging portion or through-bore 22 while being guided by the guide groove 21, as shown in FIG. 5. Under such a situation, the hood 5 (FIG. 1) can easily and simply be mounted on or removed from the deck portion of the hull without holding in the operator's arms.

Figure 3:
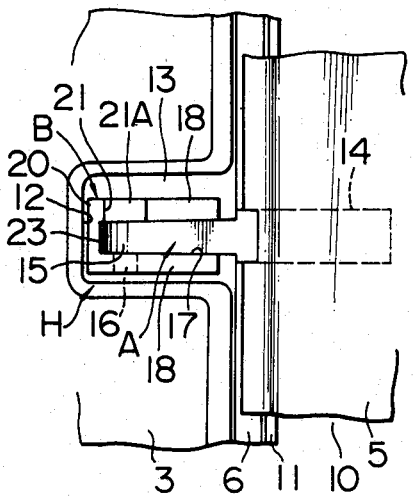
FIG. 3 is a plan view of FIG. 2.
Figure 6:
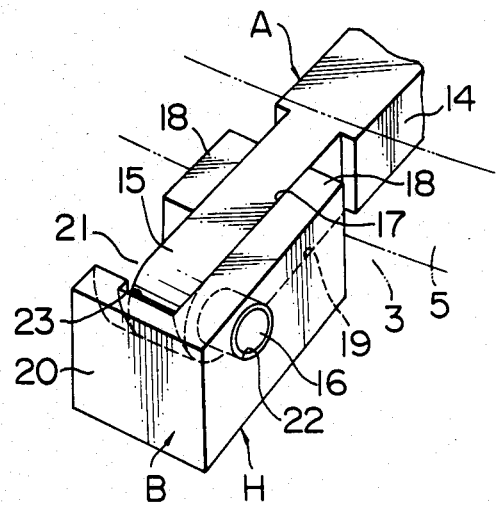

Upon completion of the connection, the first hinge element A is completely positioned within the guide groove 17 as shown in FIG. 5, so that the first hinge element A can simply be pivoted rearwardly about the second engaging portion 22. At this time, the first hinge element A is engaged in the hood-rotation guide groove 17, that is, between the upright walls 18, as shown in FIG. 6. Under such a situation, the hood 5 is placed only at its openable state as shown in FIG. 3.

When the hood 5 is to be opened, it is upwardly rotated as shown in FIG. 5, so that the first hinge element A will stand vertically in the forward end of the guide groove 17. Under such a position, the distal end 15 of the first hinge element A is positioned in coaxial alignment with the hood-removal guide groove 21.

As the first hinge element A is slidably moved laterally while maintaining its position shown in FIG. 5, the first engaging portion 16 is removed out of the second engaging portion 22. Subsequently, the first hinge element A is moved outwardly of the hood-removal guide groove 21 in the second hinge element B in the direction shown by arrow Y in FIG. 4. Thus, the hood 5 can easily and simply removed out of the opening in the deck portion.

Figure 7:
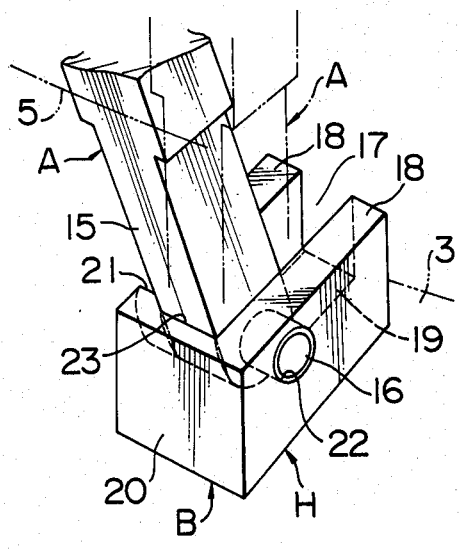

It is preferred that the front wall 20 of the second hinge element B is formed with a latching groove 23 as shown in FIG. 5. The latching groove 23 can hold the first hinge element A at its opened position as shown in FIG. 7.

It may be intended that the first hinge elements A are provided on the side of the deck portion 3 while the second hinge elements B are located on the side of the hood 5. The second engaging portion or through-bore 22 may be formed in each of the first hinge elements A while the first engaging portion or pin 16 may be formed in each of the second hinge elements B. Further, the hood 5 may be adapted to be opened laterally relative to the width direction of the hull 1. Furthermore, the second hinge elements B may be formed into ones having first and second upright walls 18 arranged in different manners.

The latch means for the rearward edge of the hood 5 may be taken as any one of various types of latch means. In the embodiment of FIG. 1, the latch means L is disposed between the upright wall 5A behind the hood 5 and the mounting wall 3A of the deck portion 3.

Figure 8:
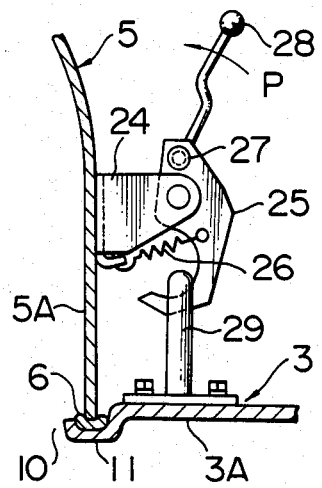
FIG. 8 is an enlarged cross-sectional view of the primary parts of FIG. 1, illustrating one embodiment of latch means.
Figure 9:
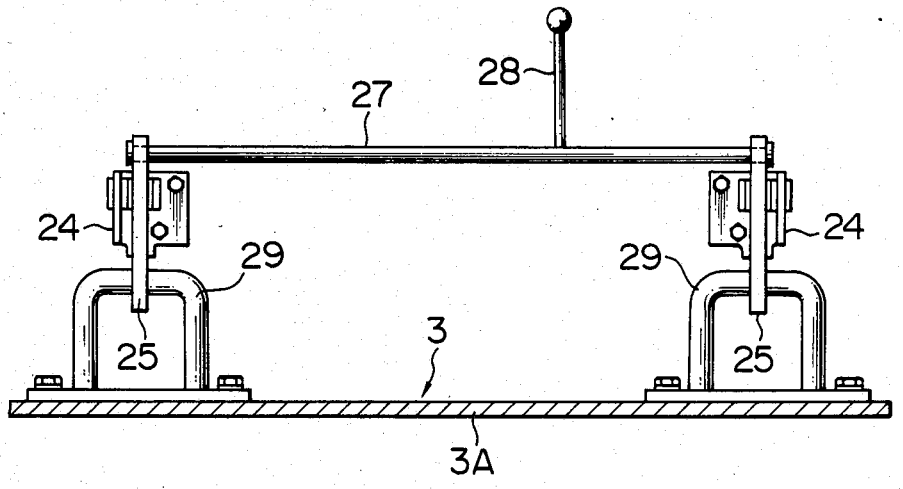
FIG. 9 is a back elevational view of FIG. 8.

More particularly, the latch means L comprises a pair of mounting brackets 24 extending outwardly from the upright wall 5A, the corresponding number of latching hooks 25 rotatably supported by the respective mounting brackets 24 and a return spring 26 spanned between each latching hook 25 and the corresponding mounting bracket 24, as shown in FIGS. 8 and 9. A connecting bar 27 also is spanned between the latching hooks 25 and includes a release lever 28 extending laterally from the connecting bar 27. Each of the latching hooks 25 is engageable in one of inverse U-shaped receiver hooks 29 extending upwardly from the mounting wall 3A.

When the release lever 28 is moved forwardly from the engaging position of FIG. 8 in a direction shown by arrow P in the same figure, each of the latching hooks 25 is disengaged out of the corresponding one of the receiver hooks 29 against the action of the respective return spring 26, such that the hood 5 can be opened. On the other hand, the hood 5 is closed while urging the release lever 28 in said direction. When the release lever 28 is then released, the receiver hooks 29 are engaged by the latching hooks 25 under the action of the return springs 26. As a result, the hood 25 is latched at its closed position.

As will be apparent from the foregoing, the present invention provides a hood mounting unit by which a hood can easily and simply be mounted on or removed from the deck opening by utilizing the first and second engaging portions guided and connected with each other in the hood-removal guide groove.

I claim:

1. A hood mounting unit suitable for use in a small-sized watercraft comprising a hull and a hood, said unit comprising at least one hinge means disposed between the hull and the hood and including first and second hinge elements, said first hinge element having a first engaging portion provided on the distal end of said first hinge element having a constant width in one direction at one side, said second hinge element having a hood-rotation guide groove having the same width as that of the distal end of said first hinge element and two opposite upright walls located on the opposite sides of said hood-rotation guide groove, one of said upright walls being formed with a second engaging portion engageable with said first engaging portion when said first engaging portion is moved in said one direction, the other of said upright walls being formed with a hood-removal guide groove engaged by the distal end of said first hinge element when said first hinge element is moved vertically relative to said hood-removal guide groove, said hood-removal guide groove having a guide face for guiding said first hinge element such that the first hinge element can be moved relative to said second hinge element in said one direction to engage said first hinge element with said second engaging portion.

2. A hood mounting unit as defined in claim 1 wherein said first hinge element is rigidly mounted on said hood and said second hinge element is rigidly mounted on said hull.

3. A hood mounting unit as defined in claim 1 wherein said first hinge element is rigidly mounted on said hull and said second hinge element is rigidly mounted on said hood.

4. A hood mounting unit as defined in claim 1 wherein said hood is openable laterally in the width direction of said hull.

5. A hood mounting unit as defined in claim 1 further comprising latch means for latching said hood at its closed position.

* * * * *